United States Patent [19]

Ward, Sr. et al.

[11] Patent Number: 4,643,413

[45] Date of Patent: Feb. 17, 1987

[54] FEEDING APPARATUS FOR PAPERBOARD SHEETS

[75] Inventors: William F. Ward, Sr., Hampstead; John B. West, Glyndon, both of Md.

[73] Assignee: The Ward Machinery Company, Cockeysville, Md.

[21] Appl. No.: 587,144

[22] Filed: Mar. 7, 1984

Related U.S. Application Data

[62] Division of Ser. No. 331,245, Dec. 16, 1981, Pat. No. 4,494,745.

[51] Int. Cl.[4] ..... B65H 3/12

[52] U.S. Cl. ..... 271/95; 271/34; 271/102; 271/112; 271/136

[58] Field of Search ..... 271/94, 95, 34, 35, 271/112, 102, 136

[56] References Cited

U.S. PATENT DOCUMENTS

| | | | |
|---|---|---|---|
| 1,092,437 | 4/1914 | Ferguson | 271/114 |
| 2,394,410 | 2/1946 | Tascher . | |
| 2,869,869 | 1/1959 | Bauer | 271/114 |
| 3,193,282 | 7/1965 | Stewart . | |
| 3,252,702 | 5/1966 | Halbert . | |
| 3,391,926 | 7/1968 | Jautinen | 271/95 X |
| 3,406,963 | 10/1968 | Goss . | |
| 3,486,749 | 12/1969 | Billings . | |
| 3,612,512 | 10/1971 | Lang . | |
| 3,625,508 | 12/1971 | Shiragai | 271/34 |
| 3,680,855 | 8/1972 | Brown . | |
| 3,734,490 | 5/1973 | Parks | 271/34 |
| 3,847,383 | 11/1974 | Wojtowicz | 271/34 X |
| 3,941,372 | 3/1976 | Matsuo . | |
| 3,981,493 | 9/1976 | Klappenecker | 271/114 X |
| 4,045,015 | 8/1977 | Sardella . | |
| 4,236,708 | 12/1980 | Matsuo . | |
| 4,451,028 | 5/1984 | Holmes | 271/94 X |
| 4,585,335 | 4/1986 | Katayama | 271/94 X |

FOREIGN PATENT DOCUMENTS

| | | |
|---|---|---|
| 1183100 | 12/1964 | Fed. Rep. of Germany . |
| 1393037 | 2/1971 | France . |
| 2045517 | 2/1971 | France . |
| 2269416 | 11/1975 | France . |
| 839920 | 6/1960 | United Kingdom . |

*Primary Examiner*—Richard A. Schacher
*Attorney, Agent, or Firm*—Boyce C. Dent

[57] ABSTRACT

A sheet feeder for corrugated paperboard sheets utilizing timed intermittently rotatable belts against which either the top or bottom sheet, depending on the configuration chosen, of a stack is brought into contact to feed such sheet in synchronism with adjacent processing machinery and utilizing continuously applied negative atmospheric pressure to hold such sheet against the belts without the need for valving or otherwise breaking the suction pressure.

13 Claims, 7 Drawing Figures

FEEDING APPARATUS FOR PAPERBOARD SHEETS

This is a divisional of co-pending application Ser. No. 06/331,245 filed Dec. 16, 1981, now U.S. Pat. No. 4,494,745.

SUMMARY OF THE INVENTION

It is an object of this invention to provide an improved timed front edge feeder for corrugated paperboard sheets utilizing intermittently rotatable belts against which either the top or bottom sheet of a stack is brought into contact to feed such sheet in synchronism with adjacent processing machinery and to utilize continuous negative atmospheric pressure to hold such sheet against the belts without the need for valving or otherwise breaking the suction pressure thereby avoiding slippage usually associated with the use of continuously rotating belts and intermittently applied suction pressure.

It is a further object to provide a simply constructed skipfeed and stopfeed mechanism enabling the feeding of sheets on alternate feed cycles of the machine and to permit selective stopfeeding.

These and other objects and advantages are achieved by providing apparatus which feeds sheets successively from one side of a stack of such sheets in timed relation so that they remain in registration as they are fed into adjacent machinery. The principles of the invention may be utilized to provide a feeder that feeds sheets from the bottom of a stack or a feeder that feeds sheets from the top of a stack. In addition, the rotatable belts may be moved into contact with the sheet to be fed relative to the position of a fixed support or, alternatively, the belts may be fixed and the support moved to bring the sheet into contact with the belts.

In the preferred embodiment, the apparatus feeds sheets successively from the bottom of a stack of such sheets in timed relation so that they remain in registration as they pass through adjacent machinery. The feeding apparatus includes a support for the stack of sheets which rests thereon with the leading edges of the sheets against a gate which is adapted to meter the sheets one at a time between the feed nip defined by the gate and support. The bottom sheets are preferably fed into a roll nip defined by a pair of pull rolls just beyond the feed nip.

The apparatus also includes a plurality of rotatable endless belts supported side by side in spaced relation across the support with each of the belts having an upper run that is moveable from a position below the top surface of the support to an upper position above the top surface. When the upper runs are in the up position they engage the bottom sheet of the stack on the support.

An indexing drive is driven in synchronism with the machine and is connnected to the belts to drive them unidirectionally from a condition of zero velocity beginning after the belts have moved to the upper position to a condition of maximum velocity while the belts are in the upper position and to decelerate the belts to zero velocity beginning when the upper runs are being lowered to their lower position and at which time they are slightly below the top surface of the support.

The upper runs of the belts are lifted by bars beneath each of the runs which are actuated through a lever arrangement from a cam so as to lift the upper runs in timed relation with rotation of the belts in such manner that the belts begin accelerating when they move to the upper position and begin decelerating when the belts are lowered to their lower position.

A vacuum duct is connected through the bottom of the support to apply suction between the belts to the bottom sheet so that the suction continuously pulls the bottom sheet against the upper runs of the belts when the belts are in the upper position to create a high frictional engagement between the bottom sheet and the belts.

The foregoing arrangement may be modified to bring the bottom sheet in contact with the belts by having the belts in a fixed position and moving the support relative to the belts. In this arrangement, the support holds the stack of sheets above the upper runs of the belts and then lowers the stack until the bottom sheet rests against the upper runs. At this time, the belts are rotated thereby feeding the bottom sheet through the feed nip. As the sheet passes into the roll nip beyond the feed nip, the support is raised to lift the stack off the belts at which time the belts are decelerated until the support again lowers the stack to contact the belts.

In the foregoing arrangement, an extension is formed on the bottom of the support which engages the cam to raise and lower the support in timed relation with rotation of the belts as previously described in connection with the preferred embodiment.

This invention may also be adapted to feed the top sheet of a stack if desired. In essence, the previously described preferred arrangement is turned upside down and above the stack of sheets. The stack is supported on an elevator mechanism arranged to raise the stack and the top sheets are fed in the manner described for the preferred embodiment.

The top feed arrangement just described may also be modified to move the support relative to the belts in a fixed position much the same as such modification was described in connection with the preferred embodiment.

There are times when it is desirable to feed sheets longer than can normally be accommodated during a single feeding cycle of the apparatus. To accomodate such sheets, with respect to the preferred embodiment, a pivotable lever that is used to raise the bars beneath the belts by action of the aforementioned cam is in effect pulled away from the cam on every other revolution so that the belts are raised only on every other revolution of the cam. Since the bottom sheet is fed only when the belts are raised to the upper position, a sheet is fed only upon every other revolution. This skipfeed arrangement is preferably selectively operable to prevent any feeding of the sheets thereby providing a stopfeed function.

The foregoing skipfeed and stopfeed arrangement may also be used in connection with the other embodiments as will be described.

BRIEF DESCRIPTION OF THE DRAWINGS

In the drawings wherein like parts are marked alike.

DESCRIPTION OF THE PREFERRED EMBODIMENT

Figure 1:
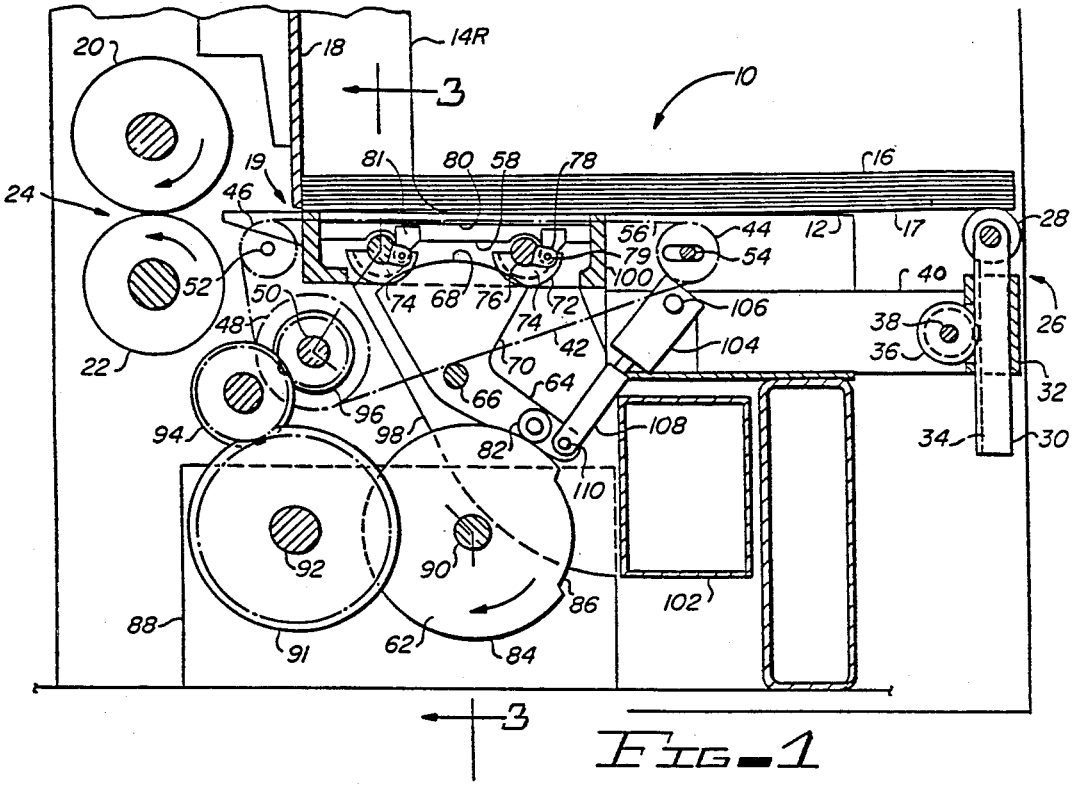
FIG. 1 is a diagrammatic illustration in side elevation of the preferred embodiment of the present invention for feeding sheets from the bottom of the stack.

Referring now to FIG. 1, the feeder of the present invention, generally designated by numeral 10, includes a support 12 secured between a pair of spaced side frames 14L and 14R of which one is shown. A stack of blanks 16 resting on top of the support 12 is positioned such that the leading edges of the blanks rest against a gate 18 spaced slightly above the top surface of the support 12 so as to permit passage or the metering of only a bottom sheet of the stack into a pair of adjacent pull rolls 20 and 22. The bottom of gate 18 and the top of the support 12 define feed nip 19. The pull rolls 20 and 22 define a pull nip 24. These pull rolls engage the leading edge of each sheet that is fed into the pull nip 24 and advances it into adjacent machinery (not shown) for further processing.

The support structure 12 also includes a rear support mechanism generally denoted by the numeral 26. As shown in FIG. 1, the trailing edge of the stack rests on a roller 28. As the bottom sheet is advanced, the trailing edge of the sheet will be drawn from the roller 28 and will fall flat against the top surface of the support 12. As well understood by those skilled in the art, the sheets in the stack 16 are often warped. The roller 28 may be raised or lowered to raise or lower the trailing edge of the stack 16. This permits the front portion of the blanks to lie substantially flat on the front portion of the support 12.

The roller 28 is mounted to a slide 30 which is adapted to slide up and down in the housing 32 of the support 26. The slide 30 may include conventional spur gear teeth 34, such as in a conventional rack, which mesh with similar teeth in a gear wheel 36 mounted to a shaft 38 which spans the distance between supports 40L and 40R (of which one is shown) of the main support 12. A hand wheel (not shown) may be attached to the shaft 38 so that the slide 30 may be raised up and down by hand. A suitable lock mechanism (not shown) may be used to hold the slide in the position selected.

Figure 3:
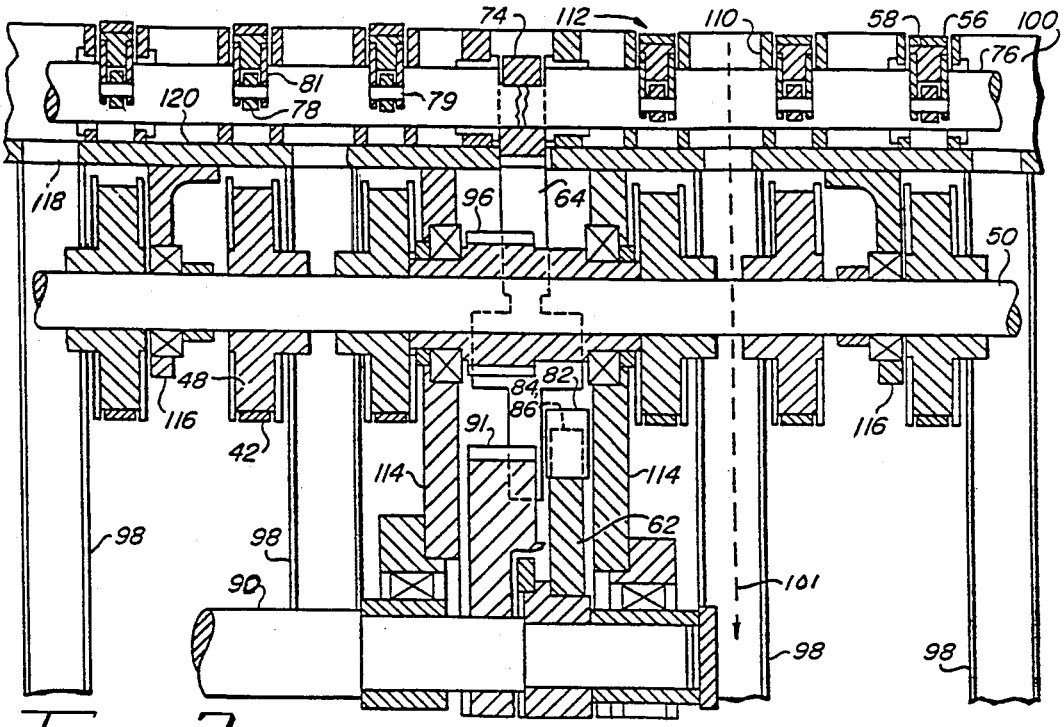
FIG. 3 is a sectional view of FIG. 1 taken along the line III—III of FIG.1.

The sheets are advanced through feed nip 19 to the pull roll nip 24 by a plurality of laterally spaced endless belts 42 (also shown in FIG. 3). The belts 42 surround pulleys 44, 46, and 48. The pulley 48 is arranged to be driven as will be explained. The pulleys are mounted on cross shafts 50, 52, and 54 suitably journaled in the support 12 (see FIG. 3). The rear shaft 54 is adjustable longitudinally away from shaft 52 in a conventional manner to maintain tautness of the belts.

Figure 2:
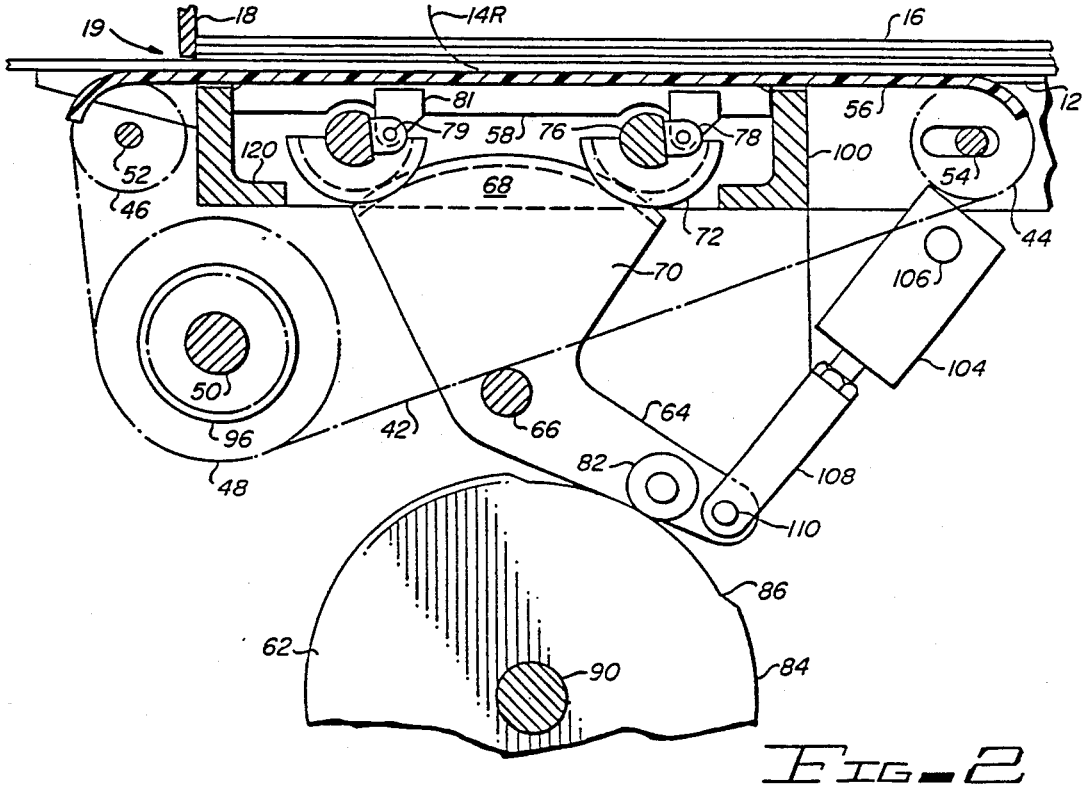
FIG. 2 is an enlarged diagrammatic illustration of a portion of FIG. 1 showing the feed belts in upper feeding position.

As shown in FIG. 1, the belts 42 include upper runs 56, extending between the pulleys 44 and 46, which lie below the top surface of the support 12 and rest on a top surface of bars 58. When the bars 58 are raised (as will be explained), the upper runs 56 are raised above the top surface of the support 12. FIG. 2 shows the top surfaces of the upper runs above the top surface of the support 12. The amount that the belts are raised above the top surface is in the range of 1/32" to 3/16" and is preferred to be about 1/16 of an inch. The upper runs 56 of the belts 42 are raised by lift bars 58, one under each upper run. The bars 58 are contained in channel 112 forming the top surface of support 12 as best shown in FIG. 3.

The bars 58 are raised by action of a rotatable cam 62 which pivots lever 64 about pivot shaft 66. Lever 64 includes conventional spur gear teeth 68 on a segment portion 70 which mesh with similar spur gear teeth 72 on identical segment gears 74. These gears are pivotable about cross shafts 76. Cross shafts 76 include a link 78 secured thereto and pivotally connected by a pin 79 to a projection 81 secured to the bottom surface of bars 58. As the cam 62 rotates, the cam follower roller 82 on the cam 62 follows the high cam surface 84 and drops onto the low surface 86 thereby pivoting lever 64 and segment gears 74 causing the links 78 to rotate and raise the bars 58 thereby raising the upper runs above the top surface of support 12 as best shown in FIG. 2.

As previously mentioned, the belts 42 are driven intermittently in such manner to begin accelerating, after they have been raised into contact with the bottom sheet, until they reach machine speed at which time the leading edge of the blank being fed reaches the pull roll nip 24 after which the belts decelerate until they reach zero velocity at which time the belts will be in their lower position below the support 12.

Intermittent rotation of the belts is achieved by use of a commercially available indexing drive such as a 4-stop, parallel shaft, 120° index angle unit of the type sold by the Commercial Cam Division of Emerson Electric Company, 1444 South Wolf Road, Wheeling, Ill. 60090, which drive is generally indicated by numeral 88 in FIG. 1. Shaft 90 is the input shaft for the drive 88 and is driven by suitable gearing from the machine drive (not shown). In effect, the input shaft 90 makes one revolution for each feed cycle of the machine. Thus, it can be seen that cam 84, also mounted on an input shaft 90, makes one revolution for each feed cycle and will thereby raise and lower the upper runs 56 of the belts 42 once during each feed cycle.

Figure 4:
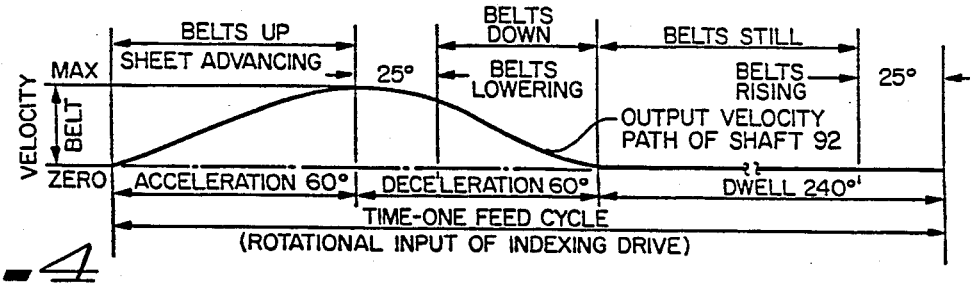
FIG. 4 is a diagram showing the relationship between belt velocity, belt position, and sheet advancement.

The drive 88 includes output shaft 92 which rotates intermittently as a result of continuous uniform rotation of input shaft 90. The rotational output velocity of shaft 92 is shown by the velocity path in FIG. 4. This motion is transmitted to the belts 42 by a conventional spur gear 91 on output shaft 92 of the drive 88 which meshes with idler gear 94 which in turn drives gear 96 to rotate pulley 48 around which belts 42 pass to impart such motion to the belts. The velocity cycle shown in FIG. 4 is repeated once for each feed cycle during which one sheet is fed into pull roll nip 24. Cam 62 is circumferentially located on input shaft 90 so as to syncronize operation of the lift bars 58 with the velocity of the belts 42 such that the upper runs 56 reach their upper position in contact with the bottom sheet just as the belts 42 begin to accelerate. The circumferential length of the cam surface 86 is such that the upper runs 56 of the belts are kept in contact with the bottom sheet until the sheet reaches maximum velocity at which time its leading edge will have advanced into pull roll nip 24. At this point, cam surface 84 raises roller 82 causing lever 64 to pivot and consequently lowers the upper runs 56 beneath the surface of support 12. As this occurs, the indexing drive 88 begins decelerating belts 42, as they are lowered to beneath support 12, until they stop where they remain in a dwell position until they are again raised to their upper position in contact with the next bottom sheet.

The foregoing relationship is graphically represented in FIG. 4. The lifting mechanism is timed such that the upper runs 56 are lifted above the top of support 12 just before the belts begin accelerating from zero velocity. Acceleration continues to maximum, with the bottom sheet being advanced by the upper runs 56, during the time it takes for the input shaft 90 of the indexing drive to rotate 60 degrees. At the point of maximum velocity, the lifting mechanism begins to lower the upper runs beneath the top of support 12. Deceleration of the upper runs 56 begins as they lower beneath the support 12 but the sheet continues to advance, having been gripped by the pull rolls 20 and 22; by beginning deceleration at the time the upper runs 56 move out of contact with the sheet, any drag on the sheet caused by deceleration is prevented. Such deceleration continues for another 60 degrees of rotation of input shaft 90 at which time the upper runs 56 have been fully lowered. When zero velocity has been reached, the belts 42 remain at dwell for a period of 240 degrees rotation of input shaft 90. However, during a latter part of the dwell period, the cam 62 will have caused the lift bars 58 to raise the upper runs 56 above the top of support 12, ready for the next feed cycle.

Vacuum is applied to the bottom of the bottom sheet by evacuating atmosphere between the belts so as to pull the bottom sheet tightly against the top of the belts to create high frictional engagement therebetween. Thus, as the belts begin to advance from zero velocity, the sheet is vacuum coupled to them and advances at the same velocity as the belt, as previously described, through the feed nip and into the pull roll nip. Referring to FIG. 1, the vacuum is applied via ducts 98 connected to a housing 100 forming part of support 12 which lies beneath the belts and in which the lift bars 58 are contained. The duct 98 is connected to manifold duct 102 extending laterally between the side frames 14R and 14L. A blower (not shown) continuously evacuates the atmosphere from within the manifold duct 102 and duct 98. FIG. 3 shows the path of the vacuum in housing 100 between the lift bars 58 and the belts 42 to pull the bottom sheet against the top of the belts (dash line 101).

FIG. 3 is a front sectional view taken substantially along the line III—III of FIG. 1 with some parts added for the purpose of explanation even though they would not theoretically appear in such sectional view.

As best shown along the top of FIG. 3, the housing 100 forms the part of support 12 in the area of the belts 42. Longitudinally extending webs 110 form channels 112 in the top of support 12; the upper runs 56 of belts 42 are raised and lowered in these channels. For the purpose of illustration, the three upper runs 56 on the left of FIG. 3 are shown in their upper position while those on the right are shown in their lower position. Thus, the cross shaft 76 is shown broken in the center with the left hand portion rotated so that the link 78 is higher on the left than the corresponding link on the right. It can be seen that the upper runs 56 on the left protrude above the support 12 for engaging the bottom sheet of stack 16 while those on the right are below the surface of the support 12 out of engagement with the bottom sheet.

The webs 110 support the cross shafts 76 and the two webs 114 and brackets 116 support the cross shaft 50 for pulleys 48 as shown (such webs are not shown in FIG. 1). Webs 114 also support the input shaft 90 of the indexing drive 88 (drive not shown in FIG. 3) as shown. As can be seen in FIG. 3, the cam 62 is mounted to the drive input shaft 90 substantially in the lateral center of the feeder 10. The cam follower roller 82 is mounted to lever 64 and rides on the cam surface 84 and 86 and the gear teeth 68 on the top of lever 64 mesh with corresponding teeth 72 on the segment gears 74. With this centered arrangement, any twist in the various shafts is reduced as opposed to driving them from one end. Likewise, the gear 96 is also mounted near the center of cross shaft 50 for the same purpose. The various bearings, bushings, and retainer collars are not enumerated since their purpose and function are readily understood by those skilled in the art.

At this point it should be noted that the feed belts 42 are preferably conventional timing belts with a high coefficient of friction material (such as soft urethane or neoprene) on their outer faces for engagement with the bottom sheets. Such belts have substantially flat teeth on their outer and inner surfaces. The inner teeth mesh with corresponding teeth on the three belt pulleys 44, 46, and 48. In this manner, the belts do not slip relative to the drive gears from the indexing drive 88 which would result in loss of timing which would lead to loss of register between the feeding of the sheets and other operations performed in the adjacent processing machinery. It should be noted that such belts usually have a nylon inner facing, which provides a low coefficient of friction between them and the top surface of lift bar 58.

The vacuum ducts 98 extend from the manifold duct 102 (manifold not shown in FIG. 3) to the housing 100 and are aligned with openings 118 in the horizontal web 120 of housing 100. Thus, it can be seen that the vacuum in the ducts 98 is applied to beneath the bottom sheet between the upright webs 110 forming the channels 112. However, vacuum is not applied through the channels 112 except for any leakage that may occur where the various shafts pass through the webs 110. As shown, vacuum is applied between every other channel 112 but may be applied between every channel if desired.

It is often desirable to feed sheets which are longer than the circumference of a printing cylinder (not shown) in the adjacent processing machinery as well understood by those skilled in the art. One revolution of such printing cylinder constitutes one feed cycle since one blank is fed for each such revolution. Thus, if sheets longer than the circumference of the print cylinder are to be fed, it can be accomplished by feeding a sheet upon every other revolution of the print cylinder, that is, one sheet upon every other feed cycle.

To achieve this, the cam follower 82 is prevented from dropping into the relief 86 on the surface of cam 62. It can be seen in FIG. 1 that the lift bars 58 remain down when the cam follower is on the high part 84 of the cam surface.

To prevent the cam follower 82 from dropping, a conventional double-acting air cylinder 104 is anchored in side frame 14R by a suitable connector 106. The ram end 108 is connected to the pivot lever 64 by a connector 110. When the cam follower roller 82 is on the high surface 84 of the cam, the air cylinder 104 is bottomed out by air pressure in the direction of the anchor connector 106 and the roller 82 cannot move away from the high surface. Air pressure applied in the opposite direction, when feeding sheets during the normal feed cycle, pushes the ram end 108 towards the lower surface 86 of the cam thereby raising the upper runs 56 as previously explained. When it is desired to skip feed, air is supplied to air cylinder 104 towards the connector 106 on every other revolution of the cam 84. This bottoms out the air cylinder, keeping roller 82 at the same height as the high surface 84 of the cam and therefore prevents lift bars 58 from raising the belts on every other feed cycle.

Air pressure may be supplied to the cylinder 104 by a conventional air valve (not shown) which can be actuated by the cam shaft 90. The valve is such that it supplies air pressure to the air cylinder 104, via appropriate air lines, on every other revolution of the cam 62.

The skip feed mechanism just described may also be used to achieve the stop-feeding function. That is, in the event of a paper jam in the feeder or adjacent processing machinery, it is desirable to stop feeding of the sheets. To accomplish this, the valve mentioned above may include a manually operable lever (not shown) which, when actuated, causes the valve to supply air pressure continuously to the air cylinder 104 thereby keeping the roller 82 in the same position as the high part 84 of the cam surface until the lever is returned to its original position. With the roller 82 in the high position, the lift bars 58 and upper runs 56 remain down, as shown in FIG. 1, so that no feeding occurs.

OPERATION

To operate the feeder, the machine is turned on at slow speed. The stop-feed lever is used to stop the belts 42 in their lower position. A stack of blanks 16 is placed on the support 12 as shown in FIG. 1 with their leading edges pushed against the gate 18. The vacuum blower is turned on which draws the bottom blank against the top of the support 12. The stop feed lever is then moved to the feed position. Upon revolution of the cam 62, the cam follower 82 will drop into the low position 86 which raises the lift bars 58 and the upper runs 56 into contact with the bottom sheet. At this time, the belts 42 begin to accelerate to machine speed, advancing the bottom blank through the feed nip 19 and into the pull roll nip 24 at which time the cam follower roller 82 has risen to the high part of the cam and the belt has lowered to be flush with the support 12 so that, as the belts 42 decelerate, there is no drag on the sheet which permits it to be advanced out of the feeder by the pull rolls 20 and 22. The cam 62 continues to turn and the cycle repeats as the cam follower roller 82 drops into the lower part 86 of the cam surface.

If the sheets are warped so that they do not lie flat against the belts, the rear support roller 28 may be raised or lowered as appropriate until it is evident that the vacuum is pulling the front portion of the lower sheet flat against the belts for proper feed. The machine speed can then be increased when it is observed that feeding is satisfactory.

If a jam occurs, the stop feed lever is moved to the stop feed position which leaves the belts in their lower position and no feeding occurs.

To feed overlength sheets, the same procedure as above is followed except that the lever is moved to the skip feed position.

Figure 5:
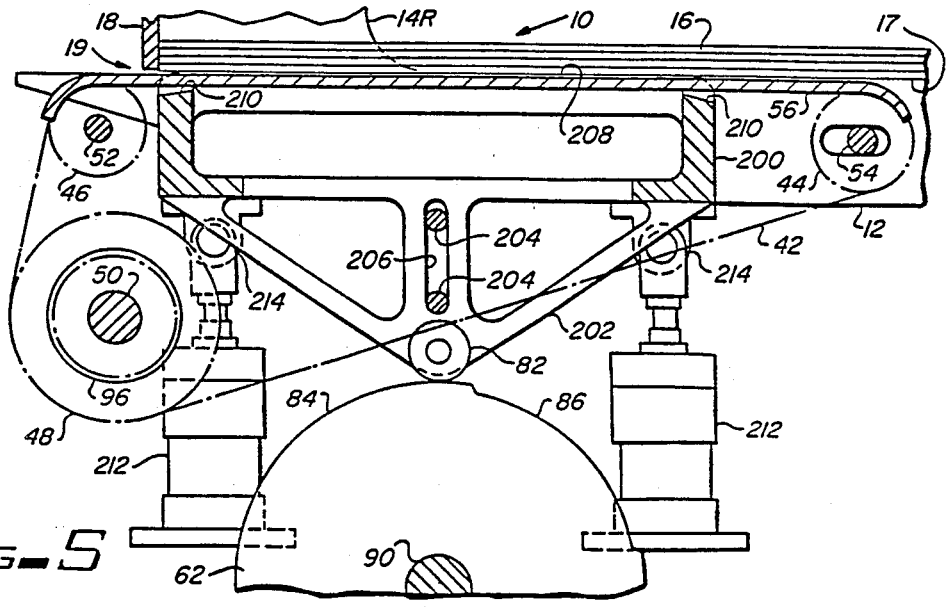
FIG. 5 is a diagrammatic illustration in side elevation of an alternate embodiment showing the stack support being moveable.

FIG. 5 shows the preferred embodiment modified so as to have the stack support moveable with respect to the rotatable belts. The rotatable belt and pulley arrangement remains the same (and the parts are identically numbered) except that the upper runs 56 are positioned in the same plane as the top surface of support 12 in FIG. 1; thus, the bottom sheet 17 will pass through the feed nip 19 as previously described in connection with the preferred embodiment. The moveable support 200 is provided with an extension 202 which is guided for vertical movement by pins 204 anchored in a convenient manner to side frames 14R and 14L (14L not shown). The pins 204 extend into a slot 206 in extension 202 as shown; thus, it can be seen that the extension 202 and support 200 will move vertically and, as shown, support 200 is in the up position with a top surface 208 supporting the stack 16 out of engagement with the upper runs 56 of belts 42. It can also be seen that as the support 200 is lowered, its top surface 208 will be beneath the upper runs 56; at this time, the belts 42 are accelerated and the bottom sheet will be fed through feed nip 19.

The moveable support 200 is provided with recesses 210 to permit passage of the upper runs 56 across the top 208 of the support. The vacuum ducts 98 have been omitted from FIG. 5 for clarity but may be arranged in much the same manner as shown in FIG. 1 except that a conventional accordian connection (not shown) can be provided where the ducts 98 are secured to the support 200 to permit the support to move vertically relative to the ducts.

The support 200 is moved simply by having the cam roller 82 ride against the high and low cam surfaces 84 and 86 of cam 62. As shown in FIG. 5, the roller 82 is on the high cam surface 84 and thus the support 200 is in its upper position supporting the stack 16 above and out of engagement with the upper runs 56. As the roller 82 passes onto low cam surface 86, during revolution of cam 62, the top surface 208 of support 200 will move below the upper runs 56 and out of contact with the bottom sheet 17. The bottom sheet 17 will be pulled against the upper runs 56 by the suction pressure of the vacuum system and will be advanced when the belts begin to accelerate.

The pneumatic cylinders 212 are secured in the conventional manner to the underside of support 200 by pin connections generally designated by numeral 214 and are suitably anchored on their opposite ends (anchors not shown). The cylinders 212 function in the same manner as cylinder 104 described in connection with FIG. 1; that is, they hold the roller 82 against the high and low cam surfaces 84 and 86. When skipfeeding is desired, air pressure is supplied to the bottom (as viewed in FIG. 5; air connection not shown) and on every other feed cycle of the apparatus. The effect of this is to keep the moveable support 200 in the upper position on every other feed cycle so that a bottom sheet is fed only on every other feed cycle. Similarly, air pressure may be supplied continuously to cylinder 212 so that no feeding occurs. This is advantageous when a jam up occurs as will be readily understood by those skilled in the art.

Figure 6:
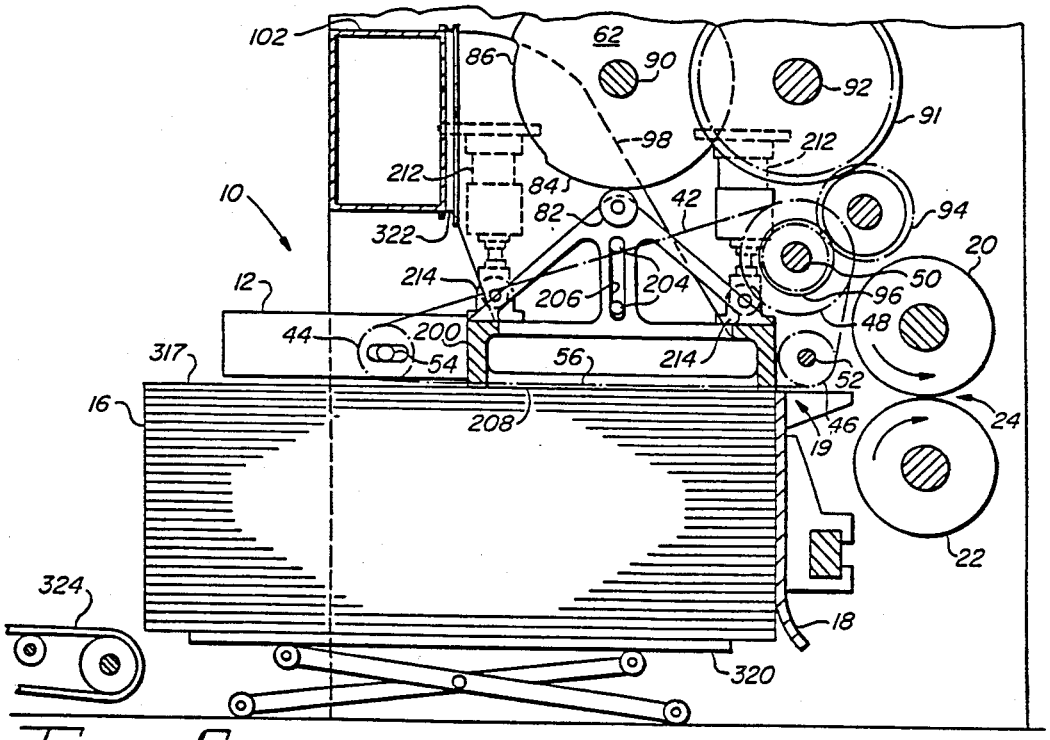
FIG. 6 is a diagrammatic illustration in side elevation of another alternate embodiment arranged to feed sheets from the top of a stack.

FIG. 6 shows how the principles of the invention may be utilized to feed the top sheet from a stack of sheets. In essence, the apparatus of FIG. 5 has been inverted and located such that the upper support 200 guides the top sheet 317 into the feed nip 19 much the same as described in connection with FIG. 1 and FIG. 5; the corresponding part numbers have been used in FIG. 6.

For top sheet feeding, the stack 16 rests on a conventional scissors lift 320 which is arranged to raise the stack incrementally as the top sheets 317 are fed from the top. With the support 200 in the down position as shown in FIG. 6, the stack is raised by the scissors lift 320 such that the top sheet 317 is pressed against the bottom surface 208 of support 200 which lies below the surface of lower runs 56 of belts 42. As cam 62 rotates, the cam roller 82 presses onto low cam surface 86 and the air pressure in cylinder 212 raises the support 200 so that top surface 208 moves above the lower runs 56. Suction through ducts 98 pulls the top sheet 317 against the lower runs 56 and, as the belts begin to accelerate, the friction between the sheet and the lower runs advance the sheet through the feed nip 19 and into the pull roll nip 24. As the top sheet enters the pull roll nip 24, the cam 62 causes the support 200 to lower to its starting position and the belts begin decelerating. At this point, the scissors lift 320 is caused to lift the stack 16 by an amount equal to the thickness of the top sheet that was previously fed. In this manner, the next top sheet is in position for feeding. As the last sheet is fed from the lift 320, it is lowered and a new stack advanced upon it by hand or from a supply conveyor 324, a portion of which is shown in FIG. 6.

The accordian connection mentioned in connection with, but not shown in, FIG. 5 is shown in FIG. 6 and denoted by numeral 322. The connection may be made from conventional duct fabric and permits movement of ducts 98 (secured to support 200) relative to the manifold 102.

Figure 7:
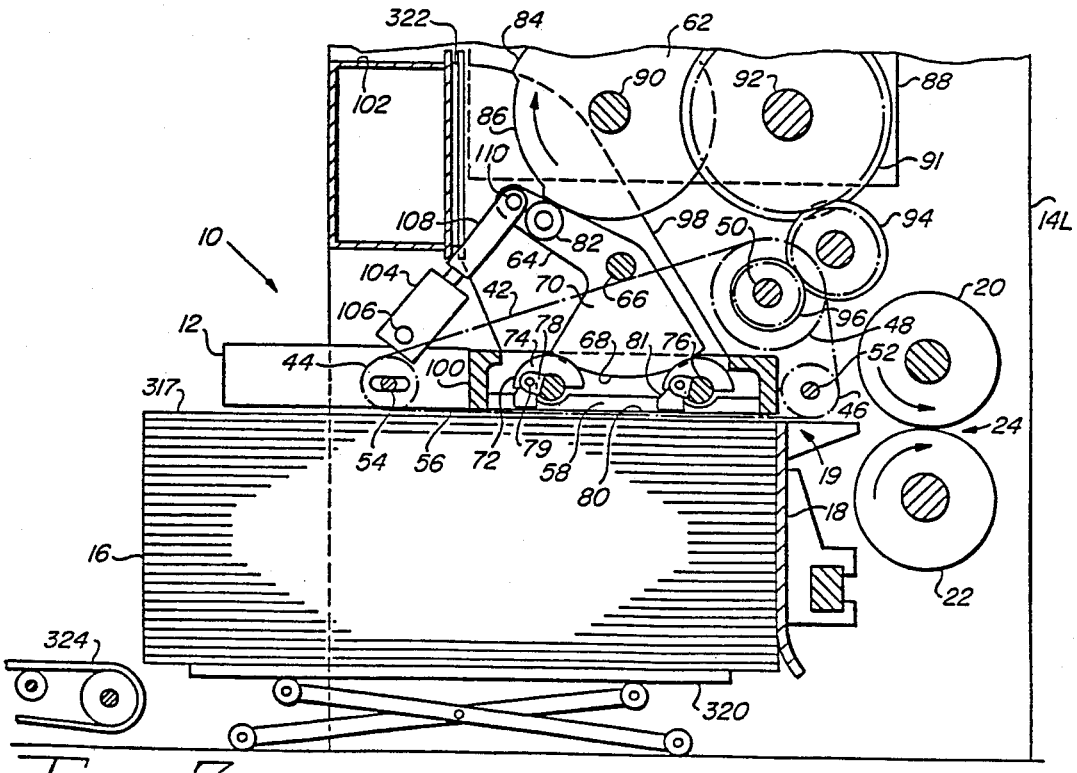
FIG. 7 is a diagrammatic illustration in side elevation of another alternate embodiment arranged to feed sheets from the top of a stack.

FIG. 7 shows how the embodiment of FIG. 1 may be inverted to feed sheets from the top of the stack. As was explained in connection with FIG. 6, the upper support guides the top sheet 317 into the feed nip 19. In this arrangement, the support 200 is fixed and the lower runs 56 of the belts 42 are brought into contact with the top sheet. This is accomplished in the same manner as in FIG. 1; that is, as cam 62 rotates, it pivots lever 64 which circumferentially reciprocates cross shafts 76 via segment gears 74, thereby moving the push bars 58 against the lower runs 56 to move them beyond the lower surface 80 of support 100 and into engagement with the top sheet 317. After engagement, the belts 42 can accelerate as previously explained, thereby advancing the top sheet. As the sheet is gripped by the pull rolls 20 and 22, the push bars 58 are raised above the bottom surface 80 of the support 100 and the belts are decelerated. Thereafter, another feed cycle occurs.

As explained in connection with FIG. 6, the stack of blanks 16 rests on a scissors lift 320 which is raised in a conventional manner to press the top sheet against the support 100.

The previously mentioned skipfeed and stopfeed functions operate in connection with the feeder arrangements described in FIGS. 5, 6, and 7 in the same manner as in the arrangement of FIG. 1.

Since the basic operation of the arrangements in FIGS. 5, 6, and 7 are quite similar to the operation of the apparatus described in connection with FIG. 1, and since the changes in operation have been described in connection with the description of the various embodiments, no further description of the operation of the various embodiments is believed necessary.

The identification of various parts, although similar, have been changed as required, depending on whether their location and direction of movement was changed due to the arrangement in which used. For example, an upper run of belts, as in FIG. 1, becomes a lower run of belts, as in FIG. 7. Such change in identification also facilitates understanding of the claims.

Thus, the invention having been described in its best embodiment and mode of operation, that which is desired to be claimed by Letters Patent is:

1. Feeding apparatus for feeding sheets successively in timed relation from above a stack of sheets comprising in combination:

(a) upper support means against which the top of said stack is positioned such that a top sheet thereof is aligned with a feed nip defined by a gate means and said upper support means, said gate means being adapted to meter said sheets one at a time through said nip;

(b) advancing means including a plurality of rotatable endless belt means supported side by side in spaced relation across said upper support means;

(c) drive means for rotating said belt means unidirectionally from zero to maximum velocity when they are in contact with said top sheet and for decelerating said belt means to zero velocity when they are out of contact with said top sheet;

(d) shifting means for bringing said top sheet into and out of contact with said belt means in timed relation thereto such that said belt means begin rotating after they come into contact with said top sheet and stop rotating after they come out of contact with said sheet; and (e) suction means in communication with said top sheet and acting between said belt means for continuously pulling said top sheet against said belt means when they are in contact with said top sheet to increase frictional engagement therebetween.

2. The apparatus of claim 1 wherein said drive means includes: an indexing drive means having an input shaft means rotatable, once for each feed cycle of said feeding apparatus, at a substantially constant velocity and having an output shaft means, connected for rotation with said belt means, rotatable at a velocity that accelerates from zero to a maximum and then decelerates to zero velocity for a predetermined time interval.

3. The apparatus of claim 2 wherein said suction means includes:

a manifold means from which atmosphere is continuously evacuated during operation of said apparatus; and duct means connected to said manifold means and to said upper support means for applying suction to said top sheet to pull the sheet into frictional engagement with said belt means.

4. The apparatus of claim 3 further including: a skipfeed means operably connected to one of said support means and said advancing menas for maintaining said belt means out of contact with said top sheet during every other feed cycle of said feeding apparatus.

5. The apparatus of claim 4 wherein: said skipfeed means is selectively operable to maintain said belt means out of contact with said top sheet to prevent feeding thereof.

6. The apparatus of claim 2 wherein each of said belt means includes:

a lower run moveable from a first position above a sheet-contacting surface of said upper support means to a second position beneath said surface and into contact with said top sheet, said drive means accelerating said belt means undirectionally from zero to maximum velocity when they are in said second position and decelerating said belt means when they are in said first position.

7. The apparatus of claim 2 wherein:

said upper support means includes a sheet contacting surface moveable from a first position beneath said belt means and in contact with said top sheet to a second position above said belt means and out of contact with said top sheet, said drive means accelerating said belt means unidirectionally from zero to maximum velocity when said sheet contacting surface is in said second position and decelerating said belt means when said surface is in said first position.

8. Feeding apparatus for feeding sheets successively in timed relation from above a stack of sheets comprising in combination:

(a) upper support means against which the top of said stack is positioned such that a top sheet thereof is aligned with a feed nip defined by a gate means and said upper support means, said gate means being adapted to meter said sheets one at a time through said nip;

(b) advancing means including a plurality of rotatable endless belt means supported side by side in spaced relation across said upper support means, each of said belt means including a lower run moveable from a first position above a sheet-contacting surface of said upper support means to a second position beneath said surface and into contact with said top sheet;

(c) drive means for rotating said belt means unidirectionally from zero to maximum velocity when they are in contact with said top sheet, and for decelerating said belt means to zero velocity when they are out of contact with said top sheet, said drive means including an indexing drive means having an input shaft means rotatable, once for each feed cycle of said feeding apparatus, at a substantially constant velocity and having an output shaft means, connected for rotation with said belt means, rotatable at a velocity that accelerates from zero to a maximum and then decelerates to zero velocity for a predetermined time interval;

(d) shifting means for bringing said top sheet into and out of contact with said belt means in timed relation thereto such that said belt means begin rotating after they come into contact with said top sheet and stop rotating after they come out of contact with said sheet, said shifting means including:

a push bar means above each of said lower runs of said belt means, a cam means connected for rotation by said input shaft means of said indexing drive means, said cam means having a high cam surface interrupted by a low cam surface, a lever means engagable with said high and low cam surfaces and pivotable thereby, and cross shaft means engageable with said push bar means and adapted to raise and lower said push bar means upon pivoting of said cross shaft means, said cross shaft means being operably connected with said lever means for pivoting said cross shaft means in response to engagement of said lever means with said high and low cam surfaces during rotation of said cam means; and (e) suction means in communication with said top sheet and acting between said belt means for continuously pulling said top sheet against said belt means when they are in contact with said top sheet to increase frictional engagement therebetween.

9. Feeding apparatus for feeding sheets successively in timed relation from above a stack of sheets comprising in combination:

(a) upper support means against which the top of said stack is positioned such that a top sheet thereof is aligned with a feed nip defined by a gate means and said upper support means, said gate means being adapted to meter said sheets one at a time through said nip, said upper support means including:

a sheet contacting surface moveable from a first position beneath said belt means and in contact with said top sheet to a second position above said belt means and out of contact with said top sheet;

(b) advancing means including a plurality of rotatable endless belt means supported side by side in spaced relation across said upper support means;

(c) drive means for rotating said belt means unidirectionally from zero to maximum velocity when they are in contact with said top sheet and for decelerating said belt means to zero velocity when they are out of contact with said top sheet, said drive means including:

an indexing drive means having an input shaft means rotatable, once for each feed cycle of said feeding apparatus, at a substantially constant velocity and having an output shaft means, connected for rotation with said belt means, rotatable at a velocity that accelerates from zero to a maximum and then decelerates to zero velocity for a predetermined time interval;

(d) shifting means for bringing said top sheet into and out of contact with said belt means in timed relation thereto such that said belt means begin rotating after they come into contact with said top sheet and stop rotating after they come out of contact with said sheet, said shifting means including:

a cam means connected for rotation by said input shaft means of said indexing drive means, said cam means having a high cam surface interrupted by a low cam surface, and an extension means connected to said upper support means for engagement with said high and low cam surfaces to move said sheet contacting surface from said first position to said second position, said drive means accelerating said belt means unidirectionally from zero to maximum velocity when said sheet contacting surface is in said second position and decelerating said belt means when said surface is in said first position; and (e) suction means in communication with said top sheet and acting between said belt means for continuously pulling said top sheet against said belt means when they are in contact with said top sheet to increase frictional engagement therebetween.

10. Feeding apparatus for feeding sheets successively in timed relation from above a stack of sheets comprising in combination:

(a) upper support means for positioning said stack against a bottom surface of said upper support means with the leading edges of individual sheets in said stack against a gate means adapted to meter said sheets one at a time through a feed nip defined by said gate means and said upper support means;

(b) advancing means including a plurality of rotatable endless belt means supported side by side in spaced relation across said upper support means, each of said belt means having a lower run moveable from a first position above a bottom surface of said upper support means to a second position beneath said bottom surface in contact with a top sheet of said stack;

(c) drive means for rotating said belt means unidirectionally from zero to maximum velocity when said lower runs are in said second position and for decelerating said belt means to said zero velocity when said lower runs are in said first position;

(d) shifting means for pushing said lower runs from said first to said second position in timed relation with rotation of said belt means such that said belt means begin rotating after they come in contact with said top sheet and stop rotating after they come out of contact with said sheet; and (e) suction means in communication with said top sheet and acting between said lower runs for continuously pulling said top sheet against said lower runs when they are in contact with said top sheet.

11. Feeding apparatus for feeding sheets successively in timed relation from above a stack of sheets comprising in combination:

(a) upper support means for positioning said stack against a bottom surface of said upper support means with the leading edges of individual sheets in said stack against a gate means adapted to meter said sheets one at a time through a feed nip defined by said gate means and said upper support means;

(b) advancing means including a plurality of rotatable endless belt means supported side by side in spaced relation across said upper support means, each of said belt means having a lower run moveable from a first position above a bottom surface of said upper support means to a second position beneath said bottom surface in contact with a top sheet of said stack;

(c) drive means for rotating said belt means unidirectionally from zero to maximum velocity when said lower runs are in said second position and for decelerating said belt means to said zero velocity when said lower runs are in said first position, said drive means comprising an indexing drive means having an input shaft means rotatable, once for each feed cycle of said feeding apparatus, at a substantially constant velocity and having an output shaft means, connected for rotation with said belt means, rotatable at a velocity that accelerates from zero to a maximum and then decelerates to zero velocity for a predetermined time interval;

(d) shifting means for pushing said lower runs from said first to said second position in timed relation with rotation of said belt means such that said belt means begin rotating after they come in contact with said top sheet and stop rotating after they come out of contact with said sheet, said shifting means including:

a push bar means above each of said lower runs; a cam means connected for rotation by said input shaft means of said indexing drive means, said cam means having a high cam surface interrupted by a low cam surface;

lever means engageable with said high and low cam surfaces and being pivotable thereby;

cross shaft means engageable with said push bar means and adapted to raise and lower said push bar means upon pivoting of said cross shaft means in response to pivoting of said lever means by said high and low cam surfaces, said cross shaft means being operably connected with said lever means for pivoting said cross shaft means in response to pivoting of said lever means by said high and low cam surfaces; and (e) suction means in communication with said top sheet and acting between said lower runs for continuously pulling said top sheet against said lower runs when they are in contact with said top sheet.

12. Feeding apparatus for feeding sheets successively in timed relation from the top of a stack of sheets comprising in combination:

(a) upper support means against which the top of said stack is moved with the leading edges of individual sheets in said stack against a gate means adapted to meter said sheets one at a time through a feed nip defined by said gate means and said upper support means;

(b) advancing means including a plurality of rotatable endless belt means supported side by side in spaced relation across said support means, said support means having a lower surface moveable from a first position in contact with a top sheet of said stack below a lower run of each of said belt means to a second position above said lower runs out of contact with said top sheet;

(c) drive means for rotating said belt means unidirectionally from zero to maximum velocity when said support means is in said second position and for decelerating said belt means to said zero velocity when said support means is in said first position;

(d) shifting means for moving said support means from said first to said second position in timed relation with rotation of said belt means by said drive means such that said belt means begin rotating after they come in contact with said top sheet and stop rotating after they come out of contact with said sheet; and (e) suction means in communication with said top sheet and acting between said belt means for continuously pulling said top sheet against said belt means when said support means is in said second position.

13. Feeding apparatus for feeding sheets successively in timed relation from the top of a stack of sheets comprising in combination:

(a) upper support means against which the top of said stack is moved with the leading edges of individual sheets in said stack against a gate means adapted to meter said sheets one at a time through a feed nip defined by said gate means and said upper support means;

(b) advancing means including a plurality of rotatable endless belt means supported side by side in spaced relation across said support means, said support means having a lower surface moveable from a first position in contact with a top sheet of said stack below a lower run of each of said belt means to a second position above said lower runs out of contact with said top sheet;

(c) drive means for rotating said belt means unidirectionally from zero to maximum velocity when said support means is in said second position and for decelerating said belt means to said zero velocity when said support means is in said first position, said drive means comprising an indexing drive means having an input shaft means rotatable, once for each feed cycle of said feeding apparatus, at a substantially constant velocity and having an output shaft means, connected for rotation with said belt means, rotatable at a velocity that accelerates from zero to maximum and then decelerates to zero velocity for a predetermined time interval;

(d) shifting means for moving said support means from said first to said second position in timed relation with rotation of said belt means by said drive means such that said belt means begin rotating after they come in contact with said top sheet and stop rotating after they come out of contact with said sheet, said shifting means including: a cam means connected for rotation by said input shaft means of said indexing drive means, said cam means having a high cam surface interrupted by a low cam surface; and extension means connected to said support means for engagement with said high and low cam surfaces to move said lower surface of said support means from said first position to said second position; and (e) suction means in communication with said top sheet and acting between said belt means for continuously pulling said top sheet against said belt means when said support means is in said second position.

* * * * *